United States Patent [19]

Nagahama et al.

[11] Patent Number: 4,708,508

[45] Date of Patent: Nov. 24, 1987

[54] INK GUIDE FOR WRITING INSTRUMENTS

[75] Inventors: Masamitsu Nagahama, Saitama; Kazunori Suzuki, Soka, both of Japan

[73] Assignee: Pentel Kabushiki Kaisha, Tokyo, Japan

[21] Appl. No.: 803,658

[22] Filed: Nov. 29, 1985

[30] Foreign Application Priority Data

Nov. 30, 1984 [JP] Japan ..... 59-253248
Feb. 27, 1985 [JP] Japan ..... 60-38464
Mar. 30, 1985 [JP] Japan ..... 60-67418

[51] Int. Cl.[4] ..... B43K 5/00
[52] U.S. Cl. ..... 401/199; 401/198
[58] Field of Search ..... 401/198, 199

[56] References Cited

U.S. PATENT DOCUMENTS 4,410,290 10/1983 Ito et al. ..... 401/198
4,424,095 1/1984 Frisch et al. ..... 156/629
4,445,951 5/1984 Lind et al. ..... 156/93
4,532,054 7/1985 Johnson ..... 252/12.4
4,533,342 8/1985 Miranti, Jr. et al. ..... 474/201
4,592,782 6/1986 Davies ..... 252/12 X

*Primary Examiner*—Steven A. Bratlie
*Assistant Examiner*—Alan W. Cannon
*Attorney, Agent, or Firm*—Wenderoth, Lind & Ponack

[57] ABSTRACT

There is provided an ink guide for a writing instrument, which is made of a synthetic resin. The synthetic resin has features (a) to (d) given below in the molecular structure or a derivative of such synthetic resin:

(a) the molecular structure has a benzene nucleus in a main chain;
(b) the benzene nucleus is coupled via an ether linkage;
(c) two ether linkages as the ether linkage noted above are present in each recurrence; and
(d) the molecular structure has a ketone group.

Examples of the synthetic resin noted above are polyetherimides and polyetheretherketones.

5 Claims, 8 Drawing Figures

INK GUIDE FOR WRITING INSTRUMENTS

BACKGROUND OF THE INVENTION

The present invention relates to members or elements for delivery of writing ink, e.g., fountain pen tips, thin rods or needles inserted in small diameter tube tips of small diameter tube writing instruments, ball point pen tips, balls of ball point pens and ball seats of ball point pens, and also to ink guides subject to wear caused by the writing surface either directly or indirectly via balls or the like.

Heretofore, various materials such as ceramics, metals and synthetic resins have been used as the materials of ink guide and suitably selected according to desired characters such as wear resistance, ink delivery property and touch of writing. Usually, inorganic materials such as ceramics and metals are used when there is a particular demand for the wear resistance, while organic materials such as synthetic resins are used when the touch of writing is taken into particular consideration. In other words, these materials are superior in some aspects but inferior in other aspects. Among the three different kinds of materials noted above, synthetic resins are used as the material of ink guide to which the invention appertains. Among such synthetic resins, those which are comparatively superior in wear resistance are selected, although the wear resistance is inferior compared to the other two kinds of materials noted above. More specifically, a large number of different synthetic resins are used for commercially available synthetic resin ink guides. A major proportion of these materials are made of polyacetals and polyamides.

Either polyacetals and polyamides however, do not have satisfactory wear resistance, although the wear resistance is superior among other synthetic resins. Therefore, a great change in the width of trace often results between the start and end of use. Or pen tip feed mechanisms are provided as additional structures to ensure long life of the writing tools.

The improvement of the wear resistance is thus greatly desired. Along with the wear resistance there are other properties which also have to be made satisfactory. One of such properties is the anti-clogging property. Even excellent wear resistance materials can not guarantee perfect freedom from wear. Therefore, the way in which the wears occurs is very important. If wear proceeds without being accompanied by sufficient division of molecules or very small particles, the material becomes frayed or nappy, resulting in an insufficient delivery of ink. In the ink guide, the ink delivery property is as important as the wear resistance. Also, if the anti-clogging property is deteriorated to a greater extent than the extent of improvement of the wear resistance, extension of life can not be promised.

SUMMARY OF THE INVENTION

An object of the present invention is to provide a new ink guide, which can be used for a long period of time.

According to the invention, there is provided an ink guide, which is made of a synthetic resin having features (a) to (d) given below in the molecular structure or a derivative of such synthetic resin:

(a) the molecular structure has a benzene nucleus in a straight chain;

(b) the benzene nucleus is coupled via an other linkage;

(c) two ether linkages as the ether linkage noted above are present in each recurrence; and (d) the molecular structure contains a ketone group.

Examples of the synthetic resin noted above are polyetheretherimides generally expressed by a formula

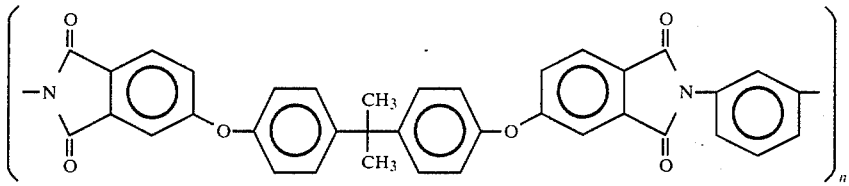

and polyetheretherdetones generally expressed as a formula

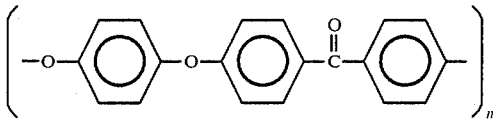

These materials may be used either in situ or as mixtures. Also, they may be used with carbon fiber or like fillers. Further, colloid particles may be attached to their surface, or colors may be provided on their surface. Further, they may be used in various forms. For example, they may be used as sinterings, as masses of fibers in the form of writing or marking pen tips or as extrusion moldings incorporating stabilizers, if necessary. Further, they may be denatured by heat or radiations.

Now, the invention will be described in connection with researches and investigations conducted by the inventors.

During their researches for materials satisfying the various characters noted above, the inventors found that polyetherimides noted above are the desired material. They considered the excellent characteristics of polyetherimides in comparison with polyacetals and polyamides.

They noted various differences of polyetherimides from polyacetals and polyamides. The features (a) to (d) noted above contribute toward the following to the characteristics.

(a) The molecular structure having a benzene nucleus in the main chain. This will reduce the flexibility of the molecule itself and contribute to the wear resistance and bending strength.

(b) the benzene nucleus being coupled via an ether linkage. This increases the molecular binding force and will contribute to the wear resistance and bending strength.

(c) Two ether linkages being present in each recurrence. This will enhance the feature (b) and hence enhances the latter contribution.

(d) The molecular structure having a ketone group. This will reduce the plasticity of the molecule itself and contribute to the anti-clogging property.

Of the above features (a) to (d) the features (a) and (d) are both possessed by a polycarbonate which is expressed as

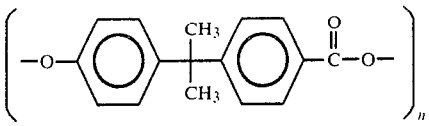

However, an ink guide using this material has very inferior wear resistance, and also its bending strength and anti-clogging property are never satisfactory. Therefore, it should be though that the various characteristics noted above are satisfied only by interactions of the features (a) to (d) with one another. Polyetheretherketones, which are expressed in a very simple formula compared to polyetherimides and nevertheless has all the features (a) to (d) are found to be never inferior to polyetherimide as the material of ink guides. This finding led the inventors to have confidence in the presence of the interactions noted above.

PREFERRED EMBODIMENTS OF THE INVENTION

Figure 1:
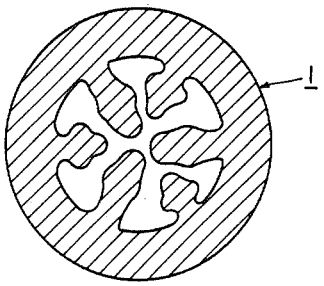
FIG. 1 is a sectional view of a pen tip for a writing instrument according to the present invention.

Preferred embodiments of the present invention will be described with reference to FIGS. 1 through 8 of the drawing.

EXAMPLE 1

This example concerns a pen tip. More specifically, a pin tip 1 having a section as shown in FIG. 1 was produced by extrusion molding. In this example, ULTEM 1000 (i.e., polyetherimide manufactured by General Electric Company) was used, and it was extruded in fused state from a 30 mm diameter die to obtain a diameter of 0.8 mm.

EXAMPLE 2

Figure 2:
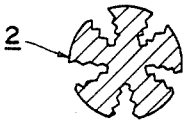
FIG. 2 is a sectional view of a thin rod for a small diameter tube type writing instrument according to the invention.
Figure 3:
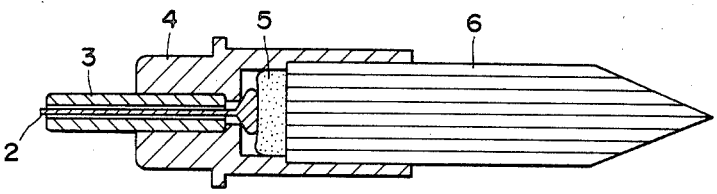
FIG. 3 is a longitudinally sectional view of an ink guide according to the invention, showing an example of use of the thin rod shown in FIG. 2.

This example concerns a thin rod inserted in a small diameter tube pen tip of a small diameter tube type writing instrument. More specifically, a thin rod 2 having a section as shown in FIG. 2 was produced by extrusion molding. ULTEM 1000 noted above was used, and it was extruded in fused state from a 30 mm diameter die to obtain a diameter of 0.15 mm. FIG. 3 shows an example of use of needle or thin rod 2, and the writing instrument has a small diameter tube pen tip 3, a holder 4 mounted in a tubular casing (not shown), porous polyurethane 5, and an ink feeding core 6. The thin rod has an increased diameter portion formed at its rear end by a thermal press process.

EXAMPLE 3

Figure 4:
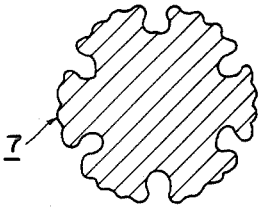
FIG. 4 is a sectional view of a ball seat for a ball point pen.
Figure 6:
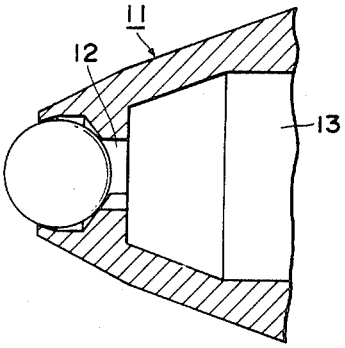
FIG. 6 is a sectional view showing a tip portion of ball point pen.
Figure 5:
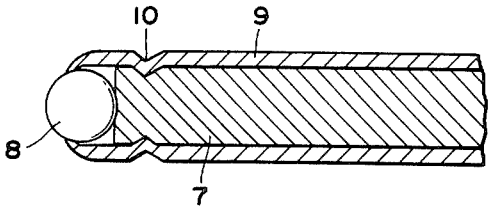
FIG. 5 shows an example of use of the ball seat shown in FIG. 4.
Figure 7:
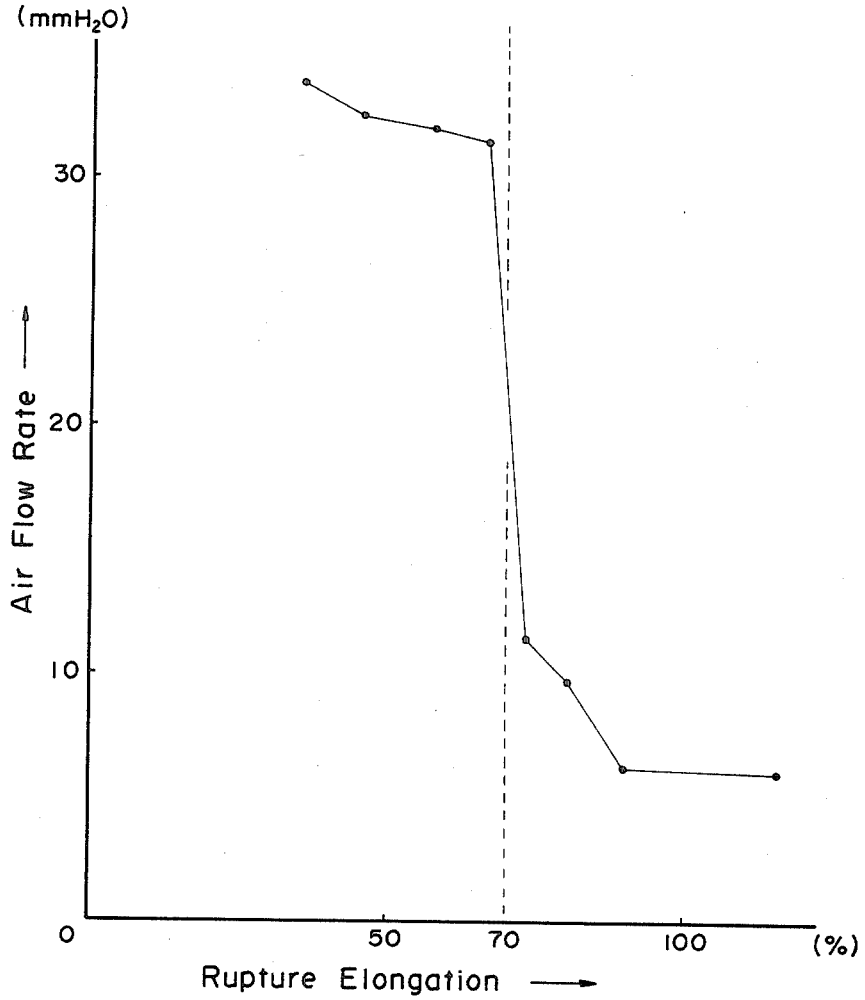
FIG. 7 is a graph showing the relationship between an air flow rate and a rupture elongation.
Figure 8:
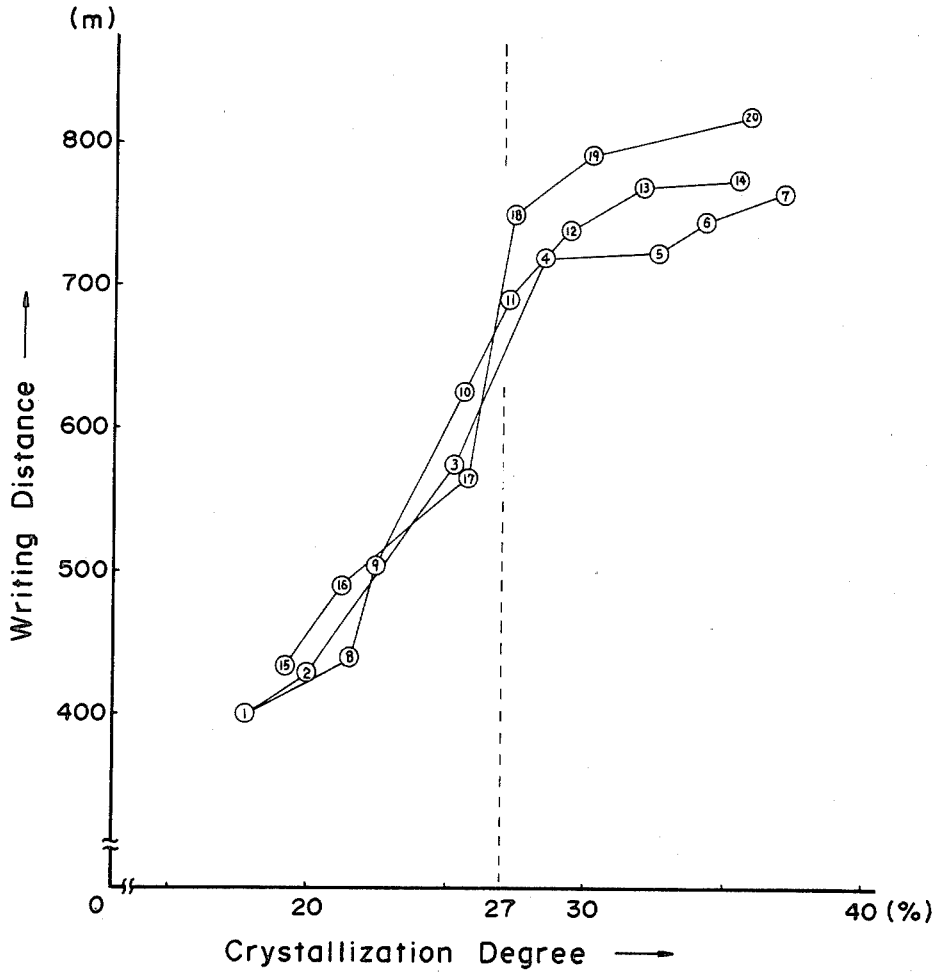
FIG. 8 is a graph showing the relationship between a writing distance and a crystallization degree.

This example concerns a ball seat of a ball point pen. More specifically, ball seat 7 having a section shown in FIG. 4 is produced by extrusion molding of monofilament self-fusion type. ULTEM 1000 noted above was used. The material was extruded in fused state from a 30 mm diameter die having a mono-filament hole with a diameter of 0.8 mm. FIG. 5 shows an example of use of ball seat 7. The instrument has a ball 8, a tubular tip 9, and a caulked portion 10 of tubular tip 9 to secure the ball seat 7.

EXAMPLE 4

This example concerns a tip for a ball point pen. More specifically, ball point pen tip 11 shown in FIG. 6 was produced by extrusion molding using a 90 ounce extrusion molder. ULTEM 1000 noted above was used. The ball tip thus produced could hold a ball with a diameter of 0.6 mm. In the figure, a guide space 12, and a space 13 in which an ink relaying core is inserted are shown.

EXAMPLES 5 TO 8

The examples 5 to 8 concern the same articles as in the respective examples 1 to 4 except for that VICTREX PEEK 450G (i.e., polyetheretherketone manufactured by Imperial Chemical Industries Co.) was used in lieu of ULTEM 1000.

EXAMPLE 9

This example concerns the same article as in the example 1 except for that a mixture composed of 70% by weight of ULTEM 1000 and 30% by weight of VICTREX PEEK 450G noted above was used in lieu of ULTEM 1000.

CONTRAST EXAMPLES 1 TO 4

The contrast examples 1 to 4 concern the same articles as in the respective examples 1 to 4 described above, except for the DURACON U10-01 (i.e., polyacetal manufactured by Polyplastics Limited) was used in lieu of ULTEM 1000.

CONTRAST EXAMPLES 5 TO 8

The contrast examples 5 to 8 concern the same articles as in the examples 1 to 4 described above, except for that DELRIN 500 (i.e., polyacetal manufactured by Du pont) was used in lieu of ULTEM 1000.

CONTRAST EXAMPLES 9 TO 12

The contrast examples 9 to 12 concern the same articles as in the respective examples 1 to 4 except for that Kanebo Nylon MC161 (i.e., polyamide manufactured by Kanebo Gosen Co., Ltd.) was used in lieu of ULTEM 1000.

Table 1 shows the results of measurement of wear resistance and bending strength of the articles of the examples 1, 5 and 9 and contrast examples 1, 5 and 9. As the wear resistance, the extent of wear of pen tip 1 with a semi-spherical tip after moving the tip over a writing surface in a perpendicular state and under a load of 200 g was measured. The bending strength is the reading of a spring weight scale when pen tip 1 secured to a support and projecting from the support by 1.0 mm was broken by being urged against the weight at an angle of 60°.

TABLE 1

| Example | Wear Resistance (mm) | Bending Strength (g) |
|---|---|---|
| Ex. 1 | 0.23 | 2200 |
| Ex. 5 | 0.16 | 2800 |
| Ex. 9 | 0.19 | 2000 |
| Con. Ex. 1 | 0.75 | 1300 |
| Con. Ex. 5 | 0.58 | 1400 |
| Con. Ex. 9 | 1.20 | 1500 |

As is seen from Table 1, the ink guide according to the invention is superior in the wear resistance and bending strength.

After the measurement of the rear resistance, the worn portion was examined. In the case of the contrast examples 1, 5 and 9, clogging due to "nappiness", or fraying was serious.

Table 2 shows the result of measurement of the dimensional stability of the articles of the examples 2 and 6 and contrast examples 2, 6 and 10. As dimensional stability the change in the length of portion of thin rod projecting from small diameter tube pen tip 3 assembled in the state of FIG. 3 after it had been held immersed in water and xylene for a sufficient period of time was measured. The initial projecting length of the thin rod was about 15 mm.

TABLE 2

| | Change in Projecting Length (mm) | |
|---|---|---|
| Example | Water | Xylene |
| Ex. 2 | 0.25 | 0.05 |
| Ex. 6 | 0.21 | 0.00 |
| Con. Ex. 2 | 0.35 | 0.30 |
| Con. Ex. 6 | 0.33 | 0.25 |
| Con. Ex. 10 | 2.70 | 0.01 |

Water and xylene are given as typical examples of the aqueous ink and oil ink. As is seen from Table 2, the ink guide according to the invention has sufficient stability.

Table 3 shows the results of measurement of the writing distance with the articles of the examples 1, 3, 4, 5, 7, 8 and 9 and contrast examples 1, 3, 4, 5, 7, 8, 9, 11 and 12. The writing distance was the distance covered by perpendicular writing with the writing instrument which was with the article in each case and filled with aquaous black ink commercially available for writing instruments until the trace was blurred. The writing tool was moved under a load of 200 g and at a speed of 7 cm/sec.

TABLE 3

| Example | Writing Distance (m) |
|---|---|
| Ex. 1 | 1,000 |
| 3 | 1,300 |
| 4 | 1,500 |
| 5 | 1,100 |
| 7 | 1,500 |
| 8 | 1,700 |
| 9 | 1,100 |
| Con. Ex. 1 | 400 |
| 3 | 500 |
| 4 | 550 |

TABLE 3-continued

| Example | Writing Distance (m) |
|---|---|
| 5 | 450 |
| 7 | 600 |
| 8 | 600 |
| 9 | 300 |
| 10 | 350 |
| 11 | 400 |

(Notes)
In the contrast examples 3, 7 and 11, 0.4 mm diameter ball which was initially projecting by approximately 0.1 mm was burried in tubular tip 9. In the contrast examples 4, 8 and 12, ball was detached.

As is seen from Table 3, the ink guide according to the invention can be used for long time.

According to the invention, it is possible to obtain an ink guide having superior wear resistance and anticlogging property to those of ink guides made of polyacetal and polyamide. Further, an ink guide made of polyetheretherketone according to the invention can have an improved anti-clogging property without deteriorating the wear resistance. To this end, the rupture elongation of the ink guide is set to 70% or below.

The rupture elongation is the elongation with respect to the initial length until rupture when elongation force is given. The rupture elongation may be reduced by irradiating the article with such radiation as γ-radiation, exposing the article to ozone or oxygen, treating the article with plasma, or subjecting the article to a chemical treatment with aqua regia, acetic acid, etc. The value of the rupture elongation may be varied by varying process conditions such as process time.

According to the invention, polyetheretherketone means derivatives thereof as well, with or without fillers such as inorganic particles incorporated at the time of molding.

The clogging which leads to insufficient ink delivery occurs when the ink guide is receiving wear such as at the time of writing. The inventors investigated means for grasping the extent of clogging. As this means, the inventors noted the rate of flow of air passed through the ink guide with a clogging trouble for a predetermined period of time. With the same condition, under which wear of the ink guide is caused, the clogging must be less when the rate of air flow is higher. With the ink guide made of polyetheretherketone, the air flow rate varies greatly at a certain value of the rupture elongation. This value is around 70%.

EXAMPLE

A cylindrical article 0.55 mm in diameter and having an axially see-through space as an ink passage was produced by extruding from an extrusion molder and rolling VICTREX PEEK 450G (i.e., polyetheretherketone manufactured by Imperial Chemical Industries Co.). A die having an ink passage pattern was mounted at an end of the extrusion machine. The die had a discharge hole diameter of 15 mm.

The circular article obtained in this way is referred to as example A. This example A had a rupture elongation of 115% as measured by a tension tester. A plurality of cylindrical articles of example A were irradiated with γ-radiation of various irradiation energy levels for various periods to obtain articles with rupture elongation values of 89, 73, 57 and 35%. These articles are referred to as examples B, C, D and E in the mentioned order. Further, articles with rupture elongation values of 80 and 45% were obtained through plasma treatment of articles of the example A, and an article with a rupture elongation value of 66% was obtained through a heating treatment. These articles are referred to as examples F, G and H in the mentioned order.

The article of each example was neatly cut to a length of 30 mm, and then provided at one end with a semi-spherical portion having the shape of a pen tip through a shaping step. Then, air is passed through the article from the end opposite the semi-spherical portion, and the rate of flow was measured. Further, the extent of wear of the end with the semi-spherical portion caused by moving it in a state urged perpendicularly against paper with a load of 100 g for 200 m was measured. The results are shown in Table 4.

TABLE 4

| Example | Rupture Elongation (%) | Air Flow Rate (mm $H_2O$) | Wear (mm) |
|---|---|---|---|
| Ex. A | 115 | 6.0 | 0.54 |
| Ex. B | 89 | 6.2 | 0.50 |
| Ex. C | 73 | 11.5 | 0.36 |
| Ex. D | 57 | 32.0 | 0.32 |
| Ex. E | 35 | 33.8 | 0.28 |
| Ex. F | 80 | 9.8 | 0.35 |
| Ex. G | 45 | 32.5 | 0.30 |
| Ex. H | 66 | 31.5 | 0.33 |

(Note)
The measurement of the air flow rate was done using an air flow meter (i.e., a leak tester manufactured by Tokyo Seimitsu Co., Ltd.), and it is higher as the pressure value (in mm $H_2O$) becomes higher.

The shaping procedure is given because it can be thought as an example of treatment where polishing, and hence clogging, occurs. As is seen from Table 4 and also from FIG. 7, which shows the relation between the air flow rate and rupture elongation, the anti-clogging property can be improved by the treatments noted above.

An ink guide made of polyetheretherketone according to the invention can have an improved anti-clogging property without deteriorating the wear resistance, as noted before. To this end, the crystallization degree of the ink guide is desirably set to 27% or above.

The crystallization degree may be increased by various well-known methods. It is also well known in the art that increasing the crystallization degree improves the mechanical strength and other mechanical properties. With an ink guide made of polyetheretherketone the anti-clogging property varies greatly at a certain value of crystallization degree. This value is around 27%. The value is obtained by an X-ray method.

EXAMPLE

A cylindrical article 0.55 mm in diameter and having an axially see-through space as an ink passage was produced by extrusing from an extrusion molder and rolling VICTREX PEEK 450 G (polyetheretherketone manufactured by Imperial Chemical Industries Co.). A die having an ink passage pattern was mounted at an end of the extrusion molder. The die had a discharge hole diameter of 15 mm. The temperature of the interior of the extrusion molder was set to 360° C. in the neighborhood of the die and 70° C. outside the die. The take-out speed is set to 20 m/min. The material being extruded from the die gained a maximum diameter of approximately 17 mm due to barus effect, and turned to loose the lustre of fusion at a point at a distance of approximately 10 cm from the die. The diameter at this point was approximately 1.0 mm.

The cylindrical article obtained in this way is referred to as example (1). A plurality of articles of example (1) wwere subject to a thermal treatment in air at 200° C. and under zero tension for 10, 30, 60, 90, 120 and 150 minutes, respectively. The treated articles are referred to as examples (2) to (7) in the mentioned order. Further, a plurality of articles of example (1) were subjected to a thermal treatment in air at 300° C. and under zero tension for 5, 10, 15, 20, 30, 40 and 50 minutes, respectively. The treated articles are referred to as examples (8) to (14) in the mentioned order. Further, a cylindrical article with a diameter of 0.55 mm was obtained by changing the take-out speed to 27 m/min. and also correspondingly changing the extrusion rate. This article is referred to as example (15). A plurality of articles of example (15) were subjected to thermal treatment in air at 200° C. and with a fixed length for 10, 30, 60, 90 and 120 minutes. The treated articles are referred to as examples (16) to (20), respectively. Further, a pen tip with a diameter of 0.55 mm was produced using commercially available polyacetal. This article is referred to as example (21).

Of the individual examples (except for example (21)) the crystallization degree was measured by the X-ray method. Further, pen tips were produced by providing one end with a semi-spherical portion through a shaping procedure. The wear of these pen tips caused by movement thereof over a writing surface in the perpendicular state and under a load of 100 g for 200 m was measured. Further, the individual examples were assembled to writing instruments sufficiently filled with a commercially available aquaous black ink for writing instruments. The distance covered in perpendicular writing with these writing instruments under a load of 100 g and a speed of 7 cm/sec. until the trace became blurred was measured. The results of the above measurement are shown in Table 5 and Table 8 (exclusing example (21)).

TABLE 5

| Example | Crystallization Degree (%) | Wear (mm) | Writing Distance (m) |
|---|---|---|---|
| Ex. 1 | 17.8 | 0.54 | 400 |
| Ex. 2 | 20.0 | 0.51 | 430 |
| Ex. 3 | 25.2 | 0.37 | 575 |
| Ex. 4 | 28.5 | 0.30 | 720 |
| Ex. 5 | 32.5 | 0.29 | 725 |
| Ex. 6 | 34.2 | 0.29 | 745 |
| Ex. 7 | 37.0 | 0.28 | 765 |
| Ex. 8 | 21.5 | 0.49 | 440 |
| Ex. 9 | 22.4 | 0.43 | 505 |
| Ex. 10 | 25.5 | 0.35 | 625 |
| Ex. 11 | 27.2 | 0.31 | 690 |
| Ex. 12 | 29.4 | 0.29 | 740 |
| Ex. 13 | 32.0 | 0.28 | 770 |
| Ex. 14 | 35.4 | 0.28 | 775 |
| Ex. 15 | 19.2 | 0.50 | 435 |
| Ex. 16 | 21.2 | 0.44 | 490 |
| Ex. 17 | 25.7 | 0.38 | 565 |
| Ex. 18 | 27.4 | 0.29 | 750 |
| Ex. 19 | 30.2 | 0.28 | 780 |
| Ex. 20 | 35.8 | 0.26 | 820 |
| Ex. 21 | | 0.86 | 250 |

As for the writing distance, trace without blur could be obtained again by merely replacing the pen tip after the trace has become blurred. Therefore, the blur is not due to lack of ink but is thought to be due to generation of clogging of the pen tip as confirmed by observation with a miroscope. Thus, the anti-clogging property can be further improved by the treatment noted above.

Although the present invention has been described with reference to the preferred embodiments thereof, many modifications and alterations can be made within the spirit of the invention.

What is claimed is:

1. An ink guide for a writing instrument, made of a synthetic resin consisting essentially of the following features (a) to (d) in the molecular structure or a derivative of said synthetic resin:

(a) a benzene nucleus is present in a main chain of the molecule;

(b) said benzene nucleus is coupled by an ether linkage;

(c) said ether linkage comprises two ether linkages in recurrence; and (d) the molecule of the synthetic resin comprises a ketone group.

2. An ink guide according to claim 1, wherein said ink guide is made of a polyetheretherketone and has a rupture elongation of 70% or below.

3. An ink guide according to claim 1, wherein said ink guide is made of a polyetheretherketone and has a crystallization degree of 27% or above.

4. An ink guide according to claim 2, wherein said ink guide is made of polyetheretherketone expressed by the formula:

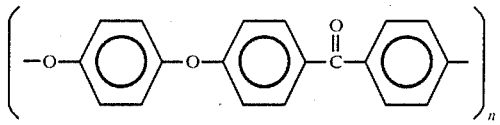

wherein n is a whole number.

5. An ink guide according to claim 1, wherein the ink guide is made of a polyetherimide of the formula:

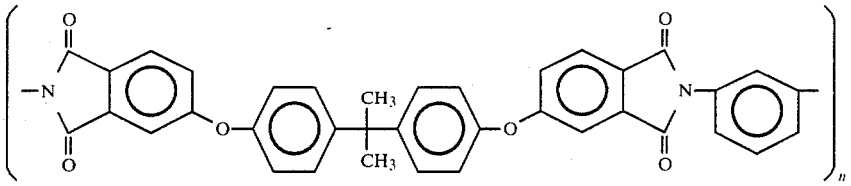

wherein n is a whole number.

* * * * *